United States Patent [19]

Albertsen

[11] 3,952,481

[45] Apr. 27, 1976

[54] CONTAINER LOADING DEVICE

[75] Inventor: Anders Albertsen, Leonardo, N.J.

[73] Assignee: Lawrence Peska Associates, Inc., New York, N.Y. ; a part interest

[22] Filed: Jan. 9, 1975

[21] Appl. No.: 539,645

[52] U.S. Cl. ..... 53/392; 248/349

[51] Int. Cl.[2] ..... B65B 67/04

[58] Field of Search ..... 53/35, 243, 255, 390, 53/392; 141/273, 391; 248/130, 201, 229, 349; 211/99; 269/57

[56] References Cited

UNITED STATES PATENTS

| | | | |
|---|---|---|---|
| 660,362 | 10/1900 | Casella | 53/392 X |
| 1,788,958 | 1/1931 | Polk | 53/392 X |
| 2,016,418 | 10/1935 | Eberling et al. | 53/392 X |
| 2,713,959 | 7/1955 | Gilbert et al. | 53/243 X |
| 2,746,226 | 5/1956 | Donald | 53/392 X |
| 2,757,500 | 8/1956 | Heinl et al. | 53/392 X |

*Primary Examiner*—Robert L. Spruill

[57] ABSTRACT

A container loading and unloading device for attaching to a counter surface comprising a support arm having a first end and a second end opposite each other. The support arm is rotatably mounted to a clamp means between the first end and the second end of the support arm. The clamp means is fixedly attached to the counter surface in such a manner that the support arm rotates in a vertical plane. A first and second pedestal are attached to the two ends of the support arm. The pedestals may be flat or shaped. The article to be loaded is placed on the pedestal in the uppermost position. A container or bag is placed over the article and the article and the container are held in position on the pedestal and the support arm is rotated 180°. The container with the article in it is then removed.

6 Claims, 3 Drawing Figures

CONTAINER LOADING DEVICE

The present invention relates broadly to bagging and unloading devices and more specifically to grocery bagging and unloading devices adapted for use in connection with checkout counters for supermarkets and the like, although this invention provides for use of the device in any area where such bagging and unloading device may be useful.

Prior to this invention various types of bagging and unloading devices have been designed for placing purchases in a container and thereafter discharging the purchases in the paper bag or the like which the customer takes home. Such devices have not been entirely satisfactory from the standpoint of operation, initial cost and maintenance, as well as human engineering features with regard to the checker or cashier in the typical supermarket.

It is an object of the present invention to provide a bagging and unloading device which is simple in nature and which is susceptible of a high degree of efficiency in operation.

Another object of the present invention is to provide a grocery bagging and unloading device constructed so as to facilitate easy placement of a bag over the pedestal supporting the groceries and to allow for easy placement of the filled bag on another counter, floor or grocery cart.

Another object of the present invention is to provide a packaging device adapted for mounting on the top of a checkout counter in a supermarket or the like, including a pedestal or shaped pedestal into which checked articles are placed, and following loading on the pedestal a paper bag can be placed thereover and the packed articles then remain packaged in the bag when the support arm and loaded pedestal are rotated 180°. This invention contemplates the rotation of the support arm to any angle greater than 90° and less than 270°, for unloading.

It is another object of my invention to provide a device from which fragile or easily bruised articles, for example, milk bottles, beer bottles, can be transferred en masse to a paper bag, container or sack without movement of the articles relative to each other.

Further objects and advantages of the invention will be apparent from the following detailed description and from the accompanying drawings illustrating one embodiment thereof, and in which.

Figure 1:
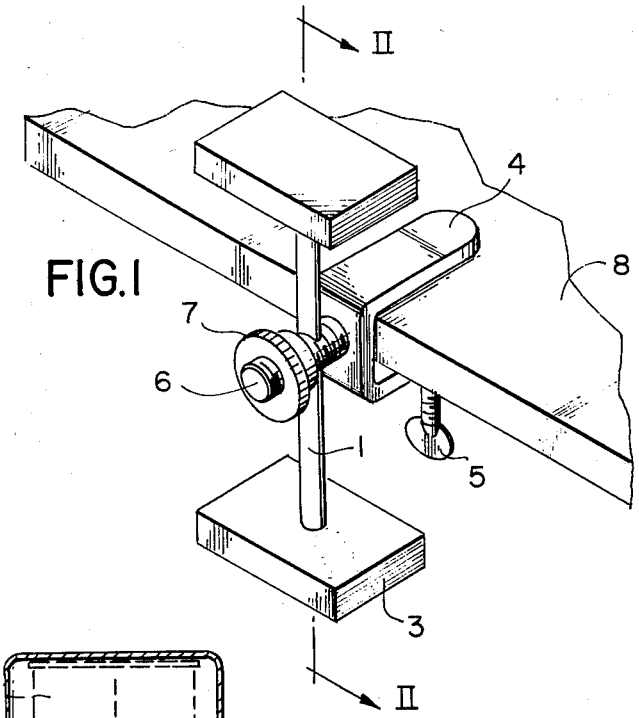
FIG. 1 is a perspective view of the loading and unloading device ready for placing articles on the pedestal.

Referring more particularly to the drawings FIG. 1 illustrates a counter surface 8 to which a clamp means is fixedly attached.

Figure 2:
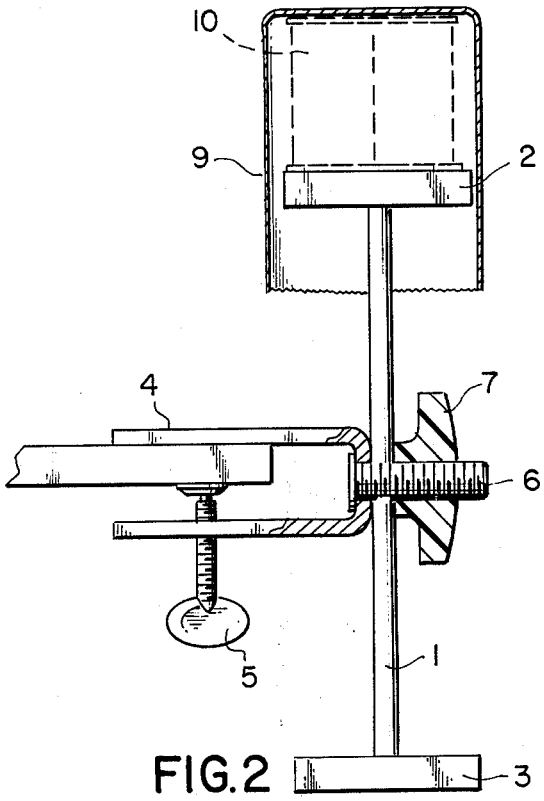
FIG. 2 is a sectional view taken along line II—II of FIG. 1.
Figure 3:
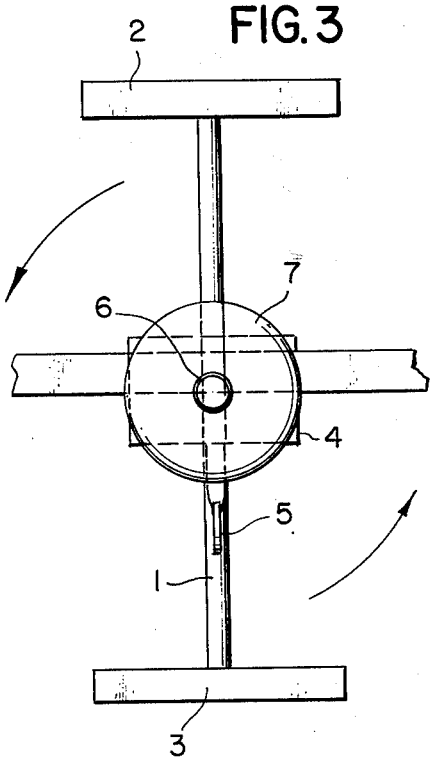
FIG. 3 is a front view of the loading and unloading device.

One type clamp means shown in FIGS. 1 and 2 is comprised of a U-shaped channel 4 having three sides. A clamp screw 5 fixedly attaches the clamp means to the surface of the counter 8. A shaft 6 passes through the third side for rotatably mounting the support arm 1 to the clamp means. A shaft nut 7 is screwably attached to the shaft 6 to prevent axial motion of the support arm 1.

The support arm 1 has a first pedestal 2 attached to the first end of the support arm and a second pedestal 3 attached to the second end of the support arm.

The clamp means is rotatably mounted to the support arm between the first end and second end of the support arm. Preferably equi-distant from the first end and second end. The clamp means is attached in such a manner to the counter surface that the support arm rotates in a vertical plane.

In operation, for example, the first pedestal 2 is placed in the uppermost position. Articles (FIGS. 2, 10) which are to be loaded into a container, bag or box (FIGS. 2, 9) is placed over the pedestal 2 and article 10. The container and the article are held tightly on the pedestal and the support arm rotated preferably 180°. The container, box or carton and the article are then removed from the pedestal and transported to the final destination. The second pedestal is then in the uppermost position, and the cycle is repeated.

This invention contemplates the use of any type support arm. For example, cylindrical, rectangular or strutted cross section.

This invention further contemplates the use of any type pedestal. For items such as beer cans and jars which will be supported on a flat surface, a flat pedestal is contemplated. For items such as granular material, loose articles which must be confined in order not to fall off the pedestal, a shaped pedestal is contemplated. The shape may be any shape suited to the article to be loaded.

This invention further contemplates the use of the clamp means rotatably mounted anywhere between the two ends of the support arm. This would be suitable for example, where the article to be packed can be alternated between a tall article and short article. Preferably the clamp means is rotatably mounted equi-distant from the first end and the second end of the support arm.

Further this invention contemplates any clamp means which can be rotatably mounted to the support arm and fixedly mounted to, for example, a counter surface. The clamp means may be fixedly mounted to a wall. For most purposes, however, this invention will be utilized on a counter surface.

This invention further contemplates rotation of the support arm in either a clockwise or counter clockwise direction.

This invention further contemplates the rotation of the support arm through at least about 90° and less than about 270°. The user of the loading and unloading device may be desirous of packing the article in the container and placing it on, for example, a conveyor belt at some intermediate level between the shaft level and the lowermost position of the pedestal. If the container and article are removed from the pedestal above the shaft level the article will fall out of the container.

For most purposes it is contemplated that the support arm be rotated 180° before unloading.

Although this invention has been described with a certain degree of particularity, it is understood that the present disclosure has been made only by way of example and that numerous changes in the details of construction and combination and arrangement of parts may be made without departing from the spirit and the scope of the invention as hereinafter claimed.

Having herein described the invention, what is claimed as new is:

1. A container loading and unloading device for attaching to a counter surface comprising:

a. a support arm having a first end and a second end opposite each other;

b. a clamp means rotatably mounted to the support arm between the first end and the second end and fixedly attached to the counter surface in such a manner that the support arm rotates in a vertical plane, wherein the clamp means is comprised of:

i. a U-shaped channel having a first side and a second side parallel to each other and a third side perpendicular to the first side and the second side;

i.i. a clamp screw passing through the first side for fixedly attaching the clamp means to the counter surface;

i.i.i. a shaft passing through the third side for rotatably mounting the support arm to the clamp means; and i.v. a shaft nut screwably attached to the shaft for preventing axial motion of the support arm on the shaft;

c. a first pedestal attached to the first end of the support arm; and d. a second pedestal attached to the second end of the support arm;

each said pedestal being adapted in turn to support an article with a bag thereover and the device being arranged to unload the bagged article from the pedestal when the support arm is rotated in the vertical plane.

2. A container loading and unloading device as claimed in claim 1, wherein the first pedestal is a flat pedestal and the second pedestal is a flat pedestal.

3. A container loading and unloading device as claimed in claim 1, wherein the first pedestal is a shaped pedestal and the second pedestal is a shaped pedestal.

4. A container loading and unloading device as claimed in claim 1, wherein the clamp means is rotatably mounted to the support arm equi-distant from the first end and the second end.

5. A container loading and unloading device as claimed in claim 1, wherein the support arm is rotated at least 90° and less than 270° for unloading the pedestal.

6. A container loading and unloading device as claimed in claim 1, wherein the support arm is rotated about 180° for unloading the pedestal.

* * * * *